US009689257B2

(12) United States Patent
Cao et al.

(10) Patent No.: US 9,689,257 B2
(45) Date of Patent: Jun. 27, 2017

(54) GUIDE RAIL ROPE DEFLECTION INHIBITION MECHANISM AND METHOD FOR PARALLEL SOFT CABLE SUSPENSION SYSTEM

(71) Applicant: CHINA UNIVERSITY OF MINING AND TECHNOLOGY, Xuzhou, Jiangsu (CN)

(72) Inventors: Guohua Cao, Jiangsu (CN); Jinjie Wang, Jiangsu (CN); Zhencai Zhu, Jiangsu (CN); Weihong Peng, Jiangsu (CN); Yandong Wang, Jiangsu (CN); Lei Zhang, Jiangsu (CN); Gang Shen, Jiangsu (CN); Shanzeng Liu, Jiangsu (CN)

(73) Assignee: CHINA UNIVERSITY OF MINING AND TECHNOLOGY, Jiangsu (CN)

( * ) Notice: Subject to any disclaimer, the term of this patent is extended or adjusted under 35 U.S.C. 154(b) by 142 days.

(21) Appl. No.: 14/418,642

(22) PCT Filed: Jan. 22, 2014

(86) PCT No.: PCT/CN2014/071086
§ 371 (c)(1),
(2) Date: Jan. 30, 2015

(87) PCT Pub. No.: WO2014/161379
PCT Pub. Date: Oct. 9, 2014

(65) Prior Publication Data

US 2016/0017708 A1 Jan. 21, 2016

(30) Foreign Application Priority Data

Apr. 3, 2013 (CN) ..... 2013 1 0117087

(51) Int. Cl.
*B66B 17/00* (2006.01)
*B66B 7/02* (2006.01)
*E21D 7/02* (2006.01)

(52) U.S. Cl.
CPC ..... *E21D 7/02* (2013.01); *B66B 7/02* (2013.01); *B66B 17/00* (2013.01)

(58) Field of Classification Search
CPC B66B 17/00; B66B 17/34; B66B 7/02; B66B 7/04; B66B 7/10; B66B 7/028; E21D 7/02
(Continued)

(56) References Cited

U.S. PATENT DOCUMENTS 5,931,265 A * 8/1999 Hollowell ..... B66B 7/062 187/249
8,499,896 B2 * 8/2013 Midtgaard ..... B66B 7/02 182/141
(Continued)

FOREIGN PATENT DOCUMENTS

CN 101224837 A 7/2008
CN 101343010 A 1/2009
(Continued)

*Primary Examiner* — William E Dondero
*Assistant Examiner* — Diem Tran
(74) *Attorney, Agent, or Firm* — Saliwanchik, Lloyd & Eisenschenk

(57) ABSTRACT

A guide rail rope deflection inhibition mechanism and method for a parallel soft cable suspension system in ultra-deep vertical shaft construction. The guide rail rope deflection inhibition mechanism comprises a T-shaped installation support base, a rotating frame, a hydraulic support rod, and a chuck. The T-shaped installation support base comprises a vertical support rod and a horizontal support rod. The hydraulic support rod comprises an upper hydraulic support rod and a lower hydraulic support rod. The rotating frame comprises an upper Y-shaped frame and a lower Y-shaped
(Continued)

frame. The chuck comprises an upper chuck and a lower chuck. The guide rail rope deflection inhibition method treats two guide rail rope deflection inhibition mechanisms as one group, and arranges at least two groups along the vertical direction on the shaft wall. While guaranteeing the smooth sliding of a direction guiding frame, the freedom of the guide rail rope part is restrained by the chuck, thereby enhancing the stability and safety of hoisting containers.

4 Claims, 3 Drawing Sheets

(58) Field of Classification Search
USPC ..... 104/202, 204, 197, 198, 199, 215, 220, 104/172
See application file for complete search history.

(56) References Cited

U.S. PATENT DOCUMENTS

| | | | | |
|---|---|---|---|---|
| 9,284,160 | B2 * | 3/2016 | Brickell | B66B 7/023 |
| 2010/0276253 | A1 | 11/2010 | Ashley | |

FOREIGN PATENT DOCUMENTS

| | | | |
|---|---|---|---|
| CN | 201208965 | Y | 3/2009 |
| CN | 101481067 | A | 7/2009 |
| CN | 101643174 | A | 2/2010 |
| CN | 102234051 | A | 11/2011 |
| CN | 103183034 | A | 7/2013 |
| EP | 2 301 881 | B1 | 3/2011 |

* cited by examiner

GUIDE RAIL ROPE DEFLECTION INHIBITION MECHANISM AND METHOD FOR PARALLEL SOFT CABLE SUSPENSION SYSTEM

CROSS REFERENCE TO A RELATED APPLICATION

This application is a National Stage Application of International Application Number PCT/CN2014/071086, filed Jan. 22, 2014; which claims priority to Chinese Patent Application No. 201310117087.6, filed Apr. 3, 2013; both of which are incorporated herein by reference in their entirety.

FIELD OF THE INVENTION

The present invention relates to construction equipment for mine shafts and drifts, in particular to a guide rail rope deflection inhibiting mechanism and a method for a parallel flexible cable suspension system, which are applicable to construction of ultra-deep vertical shafts.

BACKGROUND OF THE INVENTION

As shallow and semi-deep mineral resources are depleted gradually in China, exploiting deep resources has become an inevitable choice for ensuring sustainable development of the national economy. Therefore, it is imperative to excavate ultra-deep vertical shafts, and that mission brings higher requirements for safe transportation of personnel and materials. At present, most guide frames for deep vertical shaft construction employ two suspension ropes also as guide rail ropes, which are pre-tensioned by the dead weight of the guide frame. Such a system belongs to a typical parallel flexible cable suspension guiding system, which is mainly designed to provide guiding function for the movement of a lifting container. If the pretension of the guide rail rope of the suspension guiding system is too small, the lifting container will have a severe deflection or even turn over when it runs along the guide rail rope, which endangers life safety of the construction workers. Therefore, the "Specifications for Construction and Acceptance of Mine Shaft and Drift" specifies that the tension force per 100 m steel wire rope shall not be smaller than 1 ton when a steel-rope guide is used; in addition, the "Safety Regulations in Coal Mine" specifies that the safety factor of a cable guide shall not be lower than 6. For an ultra-deep vertical shaft, the pretension must be increased as the length of the guide rail rope is increased. However, that specification can not be met solely by means of the dead weight of the guide frame; otherwise the deflection of the lifting container will be very severe; even though the pretension meets the requirement, the steel wire rope can't be selected among standard products because of the extremely high pretension, under the constraints of tensile strength and safety factor. In summary, it is difficult to inhibit the deflection of guide rail rope in a parallel flexible cable suspension system, which brings a severe risk to the safety of construction of ultra-deep vertical shafts.

SUMMARY OF THE INVENTION

Object of the invention: an object of the present invention is to provide a guide rail rope deflection inhibiting mechanism and a method for a parallel flexible cable suspension system, in order to solve a problem that it is difficult to inhibit the guide rail rope deflection in existing parallel flexible cable suspension guiding systems in construction of ultra-deep vertical shafts.

To solve the technical problem described above, the following technical solutions are employed by the present invention:

A guide rail rope deflection inhibiting mechanism for a parallel flexible cable suspension system, comprising a 'T'-shaped mounting support, a rotary frame, a hydraulic supporting rod and a chuck, wherein the 'T'-shaped mounting support comprises a longitudinal supporting rod and a transverse supporting rod, the longitudinal supporting rod is fixed on the shaft wall, and one end of the transverse supporting rod is fixed to the center of the longitudinal supporting rod; the hydraulic supporting rod comprises an upper hydraulic supporting rod and a lower hydraulic supporting rod, one end of the upper hydraulic supporting rod is hinged to the upper end of the longitudinal supporting rod, and one end of the lower hydraulic supporting rod is hinged to the lower end of the longitudinal supporting rod; the rotary frame comprises an upper 'Y'-shaped bracket and a lower 'Y'-shaped bracket, one end of the upper 'Y'-shaped bracket is hinged to the other end of the upper hydraulic supporting rod, one end of the lower 'Y'-shaped bracket is hinged to the other end of the lower hydraulic supporting rod, and the other end of the upper 'Y'-shaped bracket is fixed to the other end of the lower 'Y'-shaped bracket, and both of the ends are hinged to the other end of the transverse supporting rod; the chuck comprises an upper chuck and a lower chuck, the upper chuck is fixed to a third end of the upper 'Y'-shaped bracket, and the lower chuck is fixed to a third end of the lower 'Y'-shaped bracket;

When the rotary frame rotates around the other end of the transverse supporting rod to a position where the lower chuck is in a horizontal state, the upper chuck will be in an up-tilting state; when the rotary frame rotates around the other end of the transverse supporting rod to a position where the upper chuck is in a horizontal state, the lower chuck will be in a down-tilting state.

In the guide rail rope deflection inhibiting mechanism according to the present invention, furthermore, said upper 'Y'-shaped bracket and said lower 'Y'-shaped bracket have the same structure, the third end of the upper 'Y'-shaped bracket and the third end of the lower 'Y'-shaped bracket are provided with a hollow steel part respectively, the hollow steel part has a bolt hole, and a fastening bolt is arranged in the bolt hole; both the upper chuck and the lower chuck comprise a 'V'-shaped chuck and a round steel part, the 'V'-shaped chuck has a snap groove that can embrace the guide rail rope, one end of the round steel part is fixed on the 'V'-shaped chuck, and the other end of the round steel part extends into the tube of the hollow steel part and is fixed by a fastening bolt.

A guide rail rope deflection inhibiting method for a parallel flexible cable suspension system, wherein, every two guide rail rope deflection inhibiting mechanisms described above are arranged into a group, and at least two groups of guide rail rope deflection inhibiting mechanisms are arranged on the shaft wall in a vertical direction;

When the lifting container is to run downward, the rotary frame in the guide rail rope deflection inhibiting mechanism is rotated to a position where the lower chuck is in a horizontal state, and the guide rail rope is secured by the lower chuck; at this point, the upper chuck is in a tilting state that permits the guide frame to pass through it; when the guide frame passes through the guide rail rope deflection inhibiting mechanism, it will push the lower chuck to retract and deflect downward gradually, and thereby the rotary frame will be driven to rotate to a position where the upper chuck is in a horizontal state, and the guide rail rope will be secured by the upper chuck;

When the lifting container is to run upward, the rotary frame in the guide rail rope deflection inhibiting mechanism is rotated to a position where the upper chuck is in a horizontal state, and the guide rail rope is secured by the upper chuck; at this point, the lower chuck is in a tilting state that permits the guide frame to pass through it; when the guide frame passes through the guide rail rope deflection inhibiting mechanism, it will push the upper chuck to retract and deflect upward gradually, and thereby the rotary frame will be driven to rotate to a position where the lower chuck is in a horizontal state, and the guide rail rope will be secured by the lower chuck.

In the guide rail rope deflection inhibiting method according to the present invention, furthermore, the spacing between two adjacent groups of guide rail rope deflection inhibiting mechanisms is 5-20 m.

The present invention has the following advantages:

(1) By adopting the guide rail rope deflection inhibiting mechanism according to the present invention and arranging it on the shaft wall reasonably, on the premise that a guide frame can slide smoothly, the chuck constrains a part of degrees of freedom of a guide rail rope to inhibit guide rail rope deflection, so that the running stability and the safety of a lifting container are improved;

(2) The guide rail rope deflection inhibiting mechanism according to the present invention is a self-actuated pure mechanical structure and does not need electric power or hydraulic drive; thus, it can effectively save cables and space in the shaft;

(3) The chucks only semi-embrace the guide rail rope; therefore, they can be installed synchronously in the construction process, which is to say, it is unnecessary to lift the hanging scaffold to the ground and renovate it; thus, the construction time can be saved;

(4) The hydraulic supporting rod has a damping function itself; thus, compared with a unit that has a single fork and is actuated by a spring, the present mechanism is more stable in transition and the shock on the guide rail rope is smaller;

(5) The guide rail rope deflection inhibiting mechanism according to the present invention is simple in structure, easy to manufacture and install, has reliable performance, and is easy to disassemble and reassemble.

Among the figures: 1—'T'-shaped mounting support, 2—rotary frame, 3—hydraulic supporting rod, 4—chuck, 5—guide rail rope, 6—guide frame, 7—lifting container, 8—shaft wall; 2-1—upper 'Y'-shaped bracket, 2-2—lower 'Y'-shaped bracket, 2-3—hollow steel part, 2-4—fastening bolt, 2-5—bolt hole; 3-1—upper hydraulic supporting rod, 3-2—lower hydraulic supporting rod; 4-1—upper chuck, 4-2—lower chuck, 4-3—'V'-shaped chuck, 4-4—round steel part.

DETAILED DESCRIPTION OF THE EMBODIMENTS

Hereunder the present invention will be further detailed with reference to the accompanying drawings.

Figure 1:
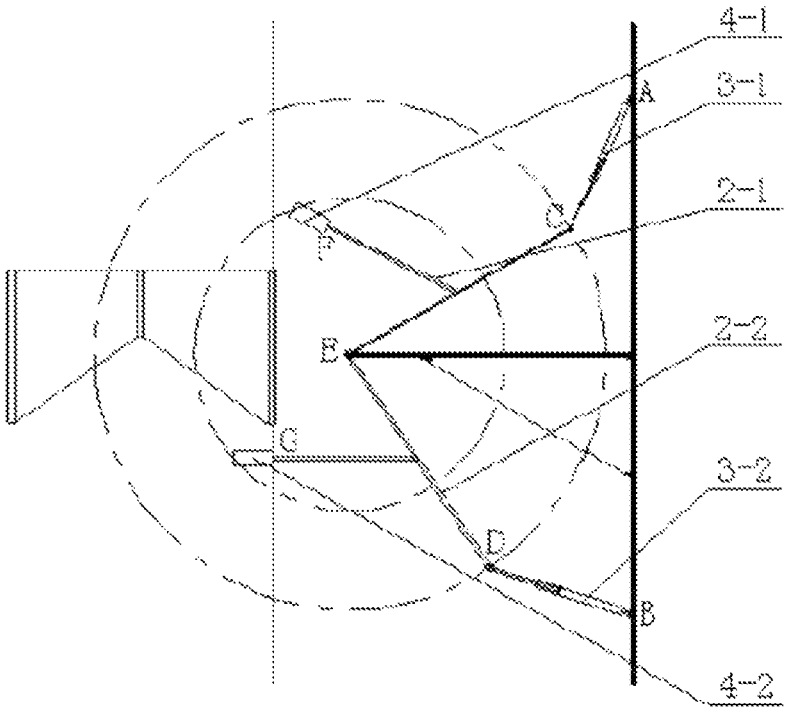
FIG. 1 is a schematic structural diagram of the guide rail rope deflection inhibiting mechanism for a parallel flexible cable suspension system according to the present invention.
Figure 2:
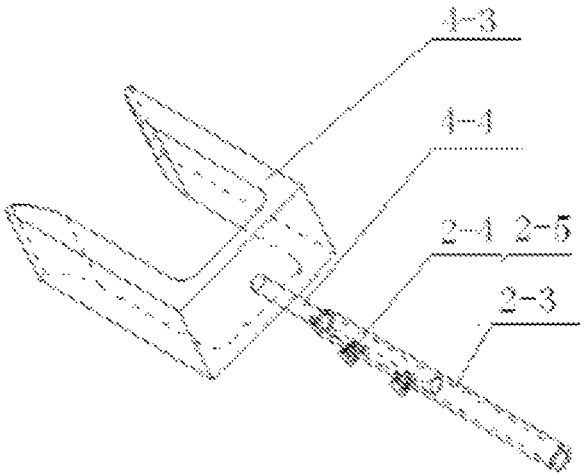
FIG. 2 is a schematic structural diagram of the connection between the rotary frame and the chucks.

As shown in FIG. 1 and FIG. 2, the guide rail rope deflection inhibiting mechanism for a parallel flexible cable suspension system according to the present invention comprises a 'T'-shaped mounting support 1, a rotary frame 2, a hydraulic supporting rod 3 and a chuck 4.

The 'T'-shaped mounting support 1 comprises a longitudinal supporting rod and a transverse supporting rod, the longitudinal supporting rod is fixed on the shaft wall 8, and one end of the transverse supporting rod is fixed to the center of the longitudinal supporting rod. The hydraulic supporting rod 3 comprises an upper hydraulic supporting rod 3-1 and a lower hydraulic supporting rod 3-2, one end of the upper hydraulic supporting rod 3-1 is hinged to the upper end (end A in the figures) of the longitudinal supporting rod, and one end of the lower hydraulic supporting rod 3-2 is hinged to the lower end (end B in the figures) of the longitudinal supporting rod. The rotary frame 2 comprises an upper 'Y'-shaped bracket 2-1 and a lower 'Y'-shaped bracket 2-2, and the upper 'Y'-shaped bracket 2-1 and lower 'Y'-shaped bracket 2-2 are in the same structure. One end (end C in the figures) of the upper 'Y'-shaped bracket 2-1 is hinged to the other end of the upper hydraulic supporting rod 3-1, one end (end D in the figures) of the lower 'Y'-shaped bracket 2-2 is hinged to the other end of the lower hydraulic supporting rod 3-2, the other end of the upper 'Y'-shaped bracket 2-1 is fixed to the other end of the lower 'Y'-shaped bracket 2-2 and hinged to the other end (end E in the figures) of the transverse supporting rod; a third end of the upper 'Y'-shaped bracket 2-1 and a third end of the lower 'Y'-shaped bracket 2-2 are provided with a hollow steel part 2-3 respectively, the hollow steel part 2-3 has a bolt hole 2-5, and a fastening bolt 2-4 is arranged in the bolt hole 2-5. The chuck 4 comprises an upper chuck 4-1 and a lower chuck 4-2, and both the upper chuck 4-1 and the lower chuck 4-2 comprise a a 'V'-shaped chuck 4-3 and a round steel part 4-4, the 'V'-shaped chuck 4-3 is arranged with a snap groove that can embrace the guide rail rope 5, one end of the round steel part 4-4 is fixed to the 'V'-shaped chuck 4-3, and the other end of the round steel part 4-4 extends into the tube of the hollow steel part 2-3 and is fixed by a fastening bolt 2-4, and thereby the upper chuck 4-1 and lower chuck 4-2 are fixed to the third end of the upper 'Y'-shaped bracket 2-1 and the third end of the lower 'Y'-shaped bracket 2-2 respectively, so that the rotary frame 2 and the chuck 4 are connected together. During use, the length of the round steel part 4-4 extending into the hollow steel tube 2-3 can be adjusted to regulate the extension length of the upper chuck 4-1 and the lower chuck 4-2, so as to secure the guide rail rope 5.

Figure 4:
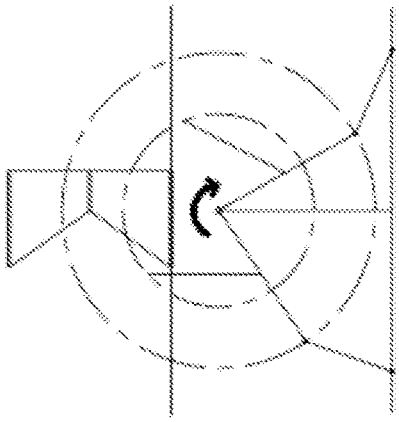
FIG. 4 is a schematic diagram illustrating a state in which the moment of resistance is negative during the movement of the deflection inhibiting mechanism.
Figure 5:
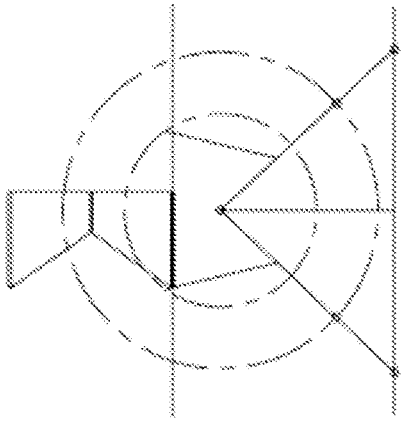
FIG. 5 is a schematic diagram illustrating a state in which the moment of resistance is zero during the movement of the deflection inhibiting mechanism.
Figure 6:
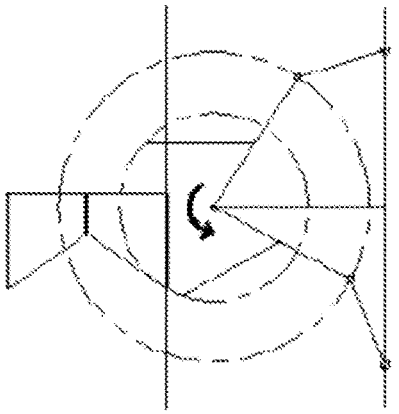
FIG. 6 is a schematic diagram illustrating a state in which the moment of resistance is positive during the movement of the deflection inhibiting mechanism.

As shown in FIG. 4, when the rotary frame 2 rotates around the other end of the transverse supporting rod to a position where the lower chuck 4-2 is in a horizontal state, the upper chuck 4-1 will be in an up-tilting state. At this point, both the upper hydraulic supporting rod 3-1 and the lower hydraulic supporting rod 3-2 are in maximum extension state; in addition, since the hydraulic supporting rod 3 provides persistent and steady pushing force, the moment of resistance to the other end of the transverse supporting rod of the 'T'-shaped mounting support 1 is negative (here, the moment in a counter-clockwise direction is defined as positive); therefore, the rotary frame 2 cannot rotate, and the guide rail rope deflection inhibiting mechanism is in a stable state. As shown in FIG. 5, when the rotary frame 2 rotates around the other end of the transverse supporting rod to a position where the upper end of the longitudinal supporting rod, one end of the upper 'Y'-shaped bracket 2-1, and the other end of the 'Y'-shaped bracket 2-1 are in the same line, the lower end of the longitudinal supporting rod, one end of the lower 'Y'-shaped bracket 2-2, and the other end of the lower 'Y'-shaped bracket 2-2 will be also in the same line. At this point, the moment of resistance of the hydraulic supporting rod 3 to the other end of the transverse supporting rod of the 'T'-shaped mounting support 1 is zero. As shown in FIG. 6, when the rotary frame 2 rotates around the other end of the transverse supporting rod to a position where the upper chuck 4-1 is in a horizontal state, the lower chuck 4-2 will be in an up-tilting state. At this point, both the upper hydraulic supporting rod 3-1 and the lower hydraulic supporting rod 3-2 are in maximum extension state; in addition, since the hydraulic supporting rod 3 provides persistent and steady pushing force, the moment of resistance to the other end of the transverse supporting rod of the 'T'-shaped mounting support 1 is positive; therefore, the rotary frame 2 cannot rotate, and the guide rail rope deflection inhibiting mechanism is in a stable state.

Figure 3:
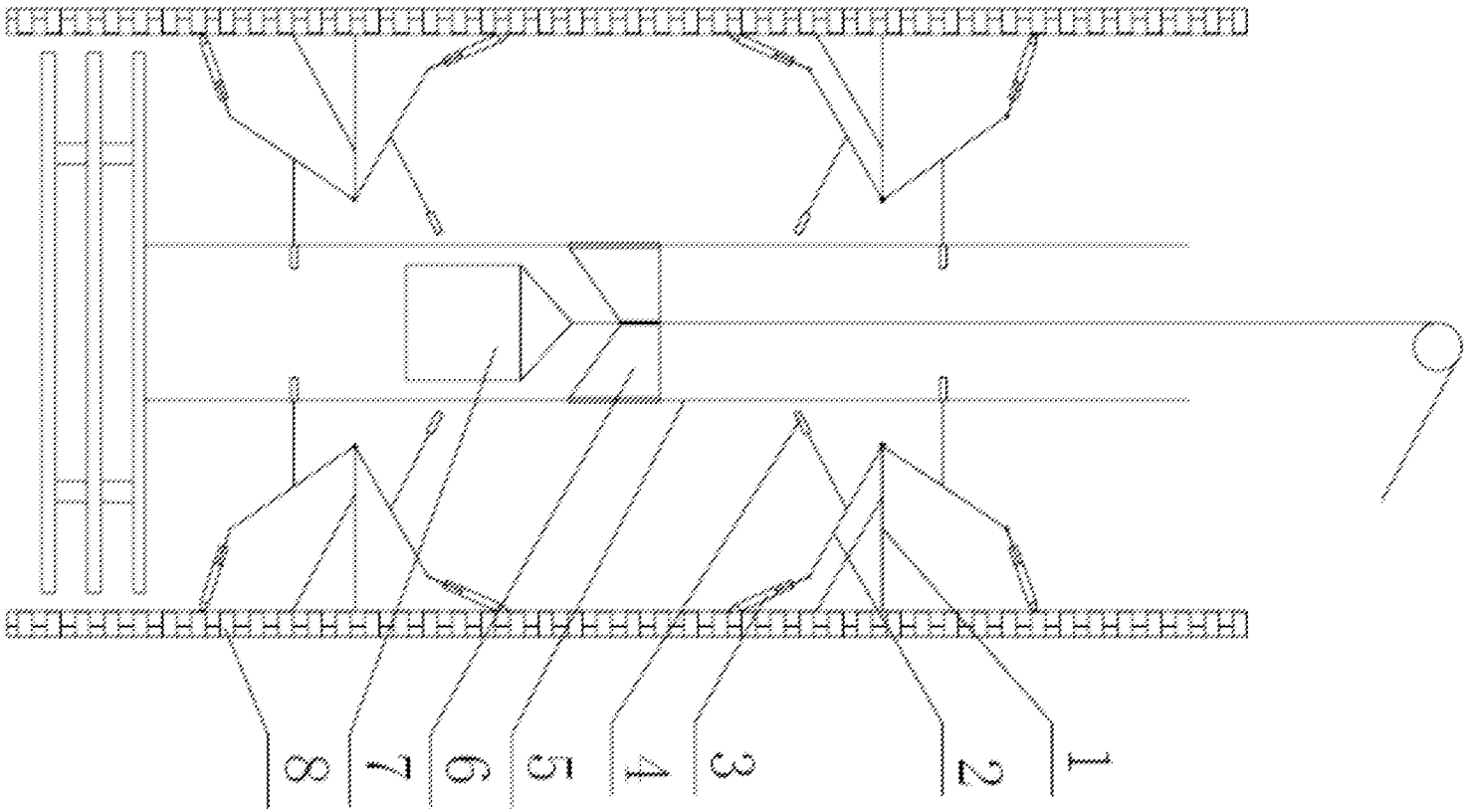
FIG. 3 is a schematic layout diagram of the guide rail rope deflection inhibiting mechanism in the guide rail rope deflection inhibiting method for a parallel flexible cable suspension system in the present invention.

As shown in FIG. 3, the guide rail rope deflection inhibiting method for a parallel flexible cable suspension system according to the present invention is characterized in that every two guide rail rope deflection inhibiting mechanisms are arranged into a group, and at least two groups of the guide rail rope deflection inhibiting mechanisms are arranged on the shaft wall 8 in a vertical direction. In this embodiment, two groups of guide rail rope deflection inhibiting mechanisms are provided, and they are arranged on the lower part (or middle part) of the guide rail rope 5, where the lateral rigidity is lower; the spacing between the two groups of guide rail rope deflection inhibiting mechanisms is 5-20 m.

When the lifting container 7 is to run downward, the rotary frames 2 of the two groups of guide rail rope deflection inhibiting mechanisms are rotated to a position where the lower chucks 4-2 are in a horizontal state, and the guide rail rope 5 are secured by the lower chucks 4-2 of the two groups of guide rail rope deflection inhibiting mechanisms; at this point, the upper chucks 4-1 of the two groups of guide rail rope deflection inhibiting mechanisms are in a tilting state that permits the guide frame 6 to pass through.

When the guide frame 6 moves downward and comes into contact with the lower chuck 4-2 of the first group of guide rail rope deflection inhibiting mechanisms, the guide frame 6 will overcome the moment of resistance produced by the hydraulic supporting rod 3 of the first group of guide rail rope deflection inhibiting mechanisms by gravity, and push the lower chuck 4-2 of the first group of guide rail rope deflection inhibiting mechanisms to retract and deflect downward gradually, and thereby drive the rotary frame 2 of the first group of guide rail rope deflection inhibiting mechanisms to rotate; when the guide frame 6 is separated from the lower chuck 4-2 of the first group of guide rail rope deflection inhibiting mechanisms, the rotary frame 2 of the first group of guide rail rope deflection inhibiting mechanisms will be rotated to a position where the upper chuck 4-1 is in horizontal state, and the guide rail rope 5 will be secured by the upper chuck 4-1 of the first group of guide rail rope deflection inhibiting mechanisms. In that process, the guide frame 6 runs downward smoothly, and passes through the first group of guide rail rope deflection inhibiting mechanisms.

When the guide frame 6 moves downward to a position between the first group of guide rail rope deflection inhibiting mechanisms and the second group of guide rail rope deflection inhibiting mechanisms, the guide rail rope 5 is secured by the upper chuck 4-1 of the first group of guide rail rope deflection inhibiting mechanisms and the lower chuck 4-2 of the second group of guide rail rope deflection inhibiting mechanisms.

When the guide frame 6 moves downward and comes into contact with the lower chuck 4-2 of the second group of guide rail rope deflection inhibiting mechanisms, the guide frame 6 will overcome the moment of resistance produced by the hydraulic supporting rod 3 of the second group of guide rail rope deflection inhibiting mechanisms by gravity, and will push the lower chuck 4-2 of the second group of guide rail rope deflection inhibiting mechanisms to retract and deflect downward gradually, and thereby drive the rotary frame 2 of the second group of guide rail rope deflection inhibiting mechanisms to rotate; when the guide frame 6 is separated from the lower chuck 4-2 of the second group of guide rail rope deflection inhibiting mechanisms, the rotary frame 2 of the second group of guide rail rope deflection inhibiting mechanisms will be rotated to a position where the upper chuck 4-1 is in horizontal state, and the guide rail rope 5 will be secured by the upper chucks 4-1 of the second group of guide rail rope deflection inhibiting mechanisms. In that process, the guide frame 6 runs downward smoothly, and passes through the second group of guide rail rope deflection inhibiting mechanisms.

After the guide frame 6 passes through the second group of guide rail rope deflection inhibiting mechanisms, the guide rail rope 5 will be secured by the upper chucks 4-1 of the two groups of guide rail rope deflection inhibiting mechanisms.

Likewise, when the lifting container 7 runs upward, the rotary frames 2 of the two groups of guide rail rope deflection inhibiting mechanisms are rotated to a position where the upper chucks 4-1 are in a horizontal state, and the guide rail rope 5 is secured by the upper chucks 4-1 of the two groups of guide rail rope deflection inhibiting mechanisms; at this point, the lower chucks 4-1 of the two groups of guide rail rope deflection inhibiting mechanisms are in a tilting state that permits the guide frame 6 to pass through.

When the guide frame 6 moves upward and comes into contact with the upper chuck 4-1 of the second group of guide rail rope deflection inhibiting mechanisms, the guide frame 6 will overcome the moment of resistance produced by the hydraulic supporting rod 3 of the second group of guide rail rope deflection inhibiting mechanisms by the upward pushing force provided by the lifting container 7, and will push the upper chuck 4-1 of the second group of guide rail rope deflection inhibiting mechanisms to retract and deflect upward gradually, and thereby drive the rotary frame 2 of the second group of guide rail rope deflection inhibiting mechanisms to rotate; when the guide frame 6 is separated from the upper chuck 4-1 of the second group of guide rail rope deflection inhibiting mechanisms, the rotary frame 2 of the second group of guide rail rope deflection inhibiting mechanisms will be rotated to a position where the lower chuck 4-2 is in horizontal state, and the guide rail rope 5 will be secured by the lower chuck 4-2 of the second group of guide rail rope deflection inhibiting mechanisms. In that process, the guide frame 6 runs upward smoothly, and passes through the second group of guide rail rope deflection inhibiting mechanisms.

When the guide frame 6 moves upward to a position between the second group of guide rail rope deflection inhibiting mechanisms and the first group of guide rail rope deflection inhibiting mechanisms, the guide rail rope 5 will be secured by the lower chuck 4-2 of the second group of guide rail rope deflection inhibiting mechanisms and the upper chuck 4-1 of the first group of guide rail rope deflection inhibiting mechanisms.

When the guide frame 6 moves upward and comes into contact with the upper chuck 4-1 of the first group of guide rail rope deflection inhibiting mechanisms, the guide frame 6 will overcome the moment of resistance produced by the hydraulic supporting rod 3 of the first group of guide rail rope deflection inhibiting mechanisms by the upward pushing force provided by the lifting container 7, and push the upper chuck 4-1 of the first group of guide rail rope deflection inhibiting mechanisms to retract and deflect upward gradually, and thereby drive the rotary frame 2 of the first group of guide rail rope deflection inhibiting mechanisms to rotate; when the guide frame 6 is separated from the upper chuck 4-2 of the first group of guide rail rope deflection inhibiting mechanisms, the rotary frame 2 of the first group of guide rail rope deflection inhibiting mechanisms will rotate to a position where the lower chuck 4-1 is in horizontal state, and the guide rail rope 5 will be secured by the lower chuck 4-2 of the first group of guide rail rope deflection inhibiting mechanisms. In that process, the guide frame 6 runs upward smoothly, and passes through the first group of guide rail rope deflection inhibiting mechanisms.

After the guide frame 6 passes through the first group of guide rail rope deflection inhibiting mechanisms, the guide rail rope 5 will be secured by the lower chucks 4-2 of the two groups of guide rail rope deflection inhibiting mechanisms.

While the present invention has been illustrated and described with reference to some preferred embodiments, the present invention is not limited to these. Those skilled in the art should recognize that various variations and modifications can be made without departing from the spirit and scope of the present invention. All of such variations and modifications shall be deemed as falling into the protection scope of the present invention.

The invention claimed is:

1. A guide rail rope deflection inhibiting mechanism for a parallel flexible cable suspension system, comprising a 'T'-shaped mounting support, a rotary frame, a hydraulic supporting rod and a chuck, wherein the 'T'-shaped mounting support comprises a longitudinal supporting rod and a transverse supporting rod, the longitudinal supporting rod is fixed on the shaft wall, and one end of the transverse supporting rod is fixed to the center of the longitudinal supporting rod; the hydraulic supporting rod comprises an upper hydraulic supporting rod and a lower hydraulic supporting rod, one end of the upper hydraulic supporting rod is hinged to the upper end of the longitudinal supporting rod, and one end of the lower hydraulic supporting rod is hinged to the lower end of the longitudinal supporting rod; the rotary frame comprises an upper 'Y'-shaped bracket and a lower 'Y'-shaped bracket, one end of the upper 'Y'-shaped bracket is hinged to the other end of the upper hydraulic supporting rod, one end of the lower 'Y'-shaped bracket is hinged to the other end of the lower hydraulic supporting rod, and the other end of the upper 'Y'-shaped bracket is fixed to the other end of the lower 'Y'-shaped bracket, and is hinged to the other end of the transverse supporting rod; the chuck comprises an upper chuck and a lower chuck, the upper chuck is fixed to a third end of the upper 'Y'-shaped bracket, and the lower chuck is fixed to a third end of the lower 'Y'-shaped bracket;

when the rotary frame rotates around the other end of the transverse supporting rod to a position where the lower chuck is in a horizontal state, the upper chuck will be in an up-tilting state; when the rotary frame rotates around the other end of the transverse supporting rod to a position where the upper chuck is in a horizontal state, the lower chuck will be in a down-tilting state.

2. The guide rail rope deflection inhibiting mechanism for a parallel flexible cable suspension system according to claim 1, wherein the upper 'Y'-shaped bracket and the lower 'Y'-shaped bracket are in the same structure, the third end of the upper 'Y'-shaped bracket and the third end of the lower 'Y'-shaped bracket are provided with a hollow steel part respectively, the hollow steel part has a bolt hole, and a fastening bolt is arranged in the bolt hole; both the upper chuck and the lower chuck comprise a 'V'-shaped chuck and a round steel part, the 'V'-shaped chuck has a snap groove that can embrace the guide rail rope, one end of the round steel part is fixed to the 'V'-shaped chuck, and the other end of the round steel part extends into the tube of the hollow steel part and is fixed by a fastening bolt.

3. A guide rail rope deflection inhibiting method for a parallel flexible cable suspension system, wherein every two guide rail rope deflection inhibiting mechanisms according to claim 1 are arranged into a group, and at least two groups of guide rail rope deflection inhibiting mechanisms are arranged on the shaft wall in a vertical direction;

when the lifting container runs downward, the rotary frame in the guide rail rope deflection inhibiting mechanism is rotated to a position where the lower chuck is in a horizontal state, and the guide rail rope is secured by the lower chuck; at this point, the upper chuck is in a tilting state that permits the guide frame to pass through; when the guide frame passes through the guide rail rope deflection inhibiting mechanism, it will push the lower chuck to retract and deflect downward gradually, and thereby the rotary frame will be driven to rotate to a position where the upper chuck is in a horizontal state, and the guide rail rope will be secured by the upper chuck;

when the lifting container is to run upward, the rotary frame in the guide rail rope deflection inhibiting mechanism is rotated to a position where the upper chuck is in a horizontal state, and the guide rail rope is secured by the upper chuck; at this point, the lower chuck is in a tilting state that permits the guide frame to pass through it; when the guide frame passes through the guide rail rope deflection inhibiting mechanism, it will push the upper chuck to retract and deflect upward gradually, and thereby the rotary frame will be driven to rotate to a position where the lower chuck is in a horizontal state, and the guide rail rope will be secured by the lower chuck.

4. The guide rail rope deflection inhibiting method for a parallel flexible cable suspension system according to claim 3, wherein the spacing between two adjacent groups of guide rail rope deflection inhibiting mechanism is 5 to 20 m.

* * * * *